US005497566A

United States Patent [19]

Kousaka et al.

[11] Patent Number: 5,497,566

[45] Date of Patent: Mar. 12, 1996

[54] METHOD OF MANUFACTURING ELEVATING SHOES

[76] Inventors: Sachiko Kousaka; Mitsuko Kousaka, both of 9-13, Shiroyamadai 3-cho, Sakai-shi, Osaka-fu; Kumiko Isaka, 41, Kannonjicho, Izumi-shi, Osaka-fu, all of Japan

[21] Appl. No.: 148,713

[22] Filed: Nov. 8, 1993

Related U.S. Application Data

[63] Continuation-in-part of Ser. No. 76,490, Jun. 14, 1993, abandoned, which is a continuation of Ser. No. 776,933, Oct. 15, 1991, abandoned.

[51] Int. Cl.[6] ..... A43B 7/16; A43B 13/38; A43B 23/00

[52] U.S. Cl. ..... 36/81; 36/43

[58] Field of Search ..... 36/43, 44, 35 R, 36/81, 82, 35 B, 97, 72 B

[56] References Cited

U.S. PATENT DOCUMENTS

| | | | |
|---|---|---|---|
| 2,016,215 | 10/1935 | Pietzuch | 36/35 R |
| 2,156,532 | 5/1939 | Greider | 36/35 R X |
| 2,205,753 | 6/1940 | Svrlinga, Jr. | 36/81 X |
| 2,378,511 | 6/1945 | Strupp | 36/35 R |
| 2,433,329 | 12/1947 | Adler et al. | 36/81 |
| 2,629,189 | 2/1953 | Stein | 36/35 R X |
| 4,910,885 | 3/1990 | Hsieh | 36/81 X |
| 5,084,987 | 2/1992 | Flemming | 36/35 R X |

FOREIGN PATENT DOCUMENTS

| | | | |
|---|---|---|---|
| 3330178 | 3/1985 | Germany | 36/81 |

*Primary Examiner*—Paul T. Sewell
*Assistant Examiner*—BethAnne Cicconi
*Attorney, Agent, or Firm*—Jordan and Hamburg

[57] ABSTRACT

An elevating shoe includes a shoe body having an upper, a sole, a heel, and an inner member provided in the shoe body for raising the height of the wearer, the heel including a heel body for supporting the weight of the wearer and a heel configuration forming member provided behind the heel body for forming a desired heel configuration, the heel configuration forming member being made of a resilient material, a rearward bottom end of the heel body being positioned forward of the rearward end of the shoe body. The inner member is formed with an elevating portion formed with a rising surface and a top surface, the rising surface extending from a peripheral edge of the inner member to the top surface without any step. In one embodiment, the heel configuration forming member is provided with an outer flexible coating.

1 Claim, 13 Drawing Sheets

METHOD OF MANUFACTURING ELEVATING SHOES

This is a Continuation-in-Part application of U.S. Ser. No. 08/076,490, filed Jun. 14, 1993, abandoned, which is a Continuation of U.S. Ser. No. 07/776,933, filed Oct. 15, 1991 (abandoned).

BACKGROUND OF THE INVENTION

The present invention relates to shoes and, particularly to elevating shoes which deceptively give the appearance that the wearer is taller.

Conventionally, elevating shoes are known which give the appearance that the wearer is taller by means of a high sole or a high heel. However, people are reluctant to put on such high heeled shoes, particularly men, because they feel ashamed of putting on such shoes.

In view thereof, there has been proposed elevating shoes in which an inner member is provided in the shoe body but whose heel configuration is maintained in a normal shape. Such shoes are disclosed, for example, in U.S. Pat. No. 4,370,817.

When the wearer puts on the shoes provided with the inner member, the appearance of the shoes is the same as that of normal shoes. However, the shoes have many problems as follows.

FIGS. 13 to 20 each show a principle in which the problem in walking is explained. FIG. 13 is a sectional view showing a shoe which is described above and which is disclosed, for example, in U.S. Pat. No. 4,370,817. Although the shoe looks like a normal shoe, an inner member 101 is provided in the shoe and a rearward portion of the inner member 101 is raised higher. When the wearer puts on this shoe, as shown in FIG. 15, the heel bone 103 is located farther backward along a circular arc 105 having its center positioned at the ankle 104 as the upper surface 102 of the rearward portion of the inner member 101 becomes higher. Consequently, the heel bone 103 is further spaced from the axis X—X of the tibia bone.

Accordingly, if the heel of the shoe is designed so as to correspond to the heel bone 103, the rearward bottom edge 106 of the heel of the shoe is spaced far apart from the tibia bone axis X—X as shown in FIG. 16. Indicated at d2 in FIG. 16 is a distance between the rearward bottom end 106 and the tibia bone axis X—X. It will be seen that the rearward bottom edge 106 of the heel in FIG. 16 is located considerably further backward from the tibia bone axis X—X as compared with heels shown in FIGS. 17 and 18. The heels of FIGS. 17 and 18 each have shorter distances d as will be further described hereinafter.

When a person puts on a shoe as shown in FIGS. 15 and 16, a greater upward moment 110 (FIG. 14) about the ankle 104 is imparted to the heel bone 103 and generates a reaction force shown by arrow 108 from a ground surface 107 as shown in FIG. 14. As a result, the wearer's muscle receives a large burden and it becomes difficult to walk. This problem is an inevitable defect in this kind of shoe.

As compared with the above shoes, in the case of shoes having a low heel or a high heel shown in FIGS. 17 and 18, the distance d is shorter and the rearward bottom edge 106 of the heel is positioned closer to the tibia bone axis X—X, thus assuring easier walking.

On the other hand, in the case of the shoe shown in FIGS. 13 and 14, which is disclosed in U.S. Pat. No. 4,370,817, more specifically, in the case of a shoe having a normal heel appearance, but having the inner member 101 for raising the height of the wearer, as shown in FIG. 16, the heel bone 103 is located farther backward along the circular arc 105 as the upper surface 102 is higher as shown in FIG. 15. Consequently, the distance d2 is greater, which makes walking more difficult. For this reason, it is hard to raise the inner member 101 to a height which the wearer would desire. In other words, the height of the inner member 101 is limited to a lower position than the wearer would desire.

FIGS. 19 and 20 are similar to FIGS. 17 and 18, respectively, but FIGS. 19 and 20 show the skeletal structure of the foot on a reduced scale and more precisely show the distance d. The distance d is substantially the same in FIGS. 19 and 20.

SUMMARY OF THE INVENTION

The present invention has been made to solve the above-mentioned problems, and it is an object of the present invention to provide elevating shoes which gives the appearance that the wearer is taller while assuring walking as comfortable as normal shoes.

Another object of the present invention is to provide an elevating shoe which can eliminate the likelihood that a third person would know of a deceptive elevating structure.

Accordingly, an elevating shoe of the present invention comprises a shoe body having an upper, a sole, and a heel, an inner member provided in the shoe body for raising the height of the wearer, the heel including a heel body for supporting the wearer and a heel configuration forming member provided behind the heel body for forming a desired heel configuration, the heel configuration forming member being made of a resilient material, a rearward bottom end of the heel body being positioned a predetermined distance forward of a rearward end of the shoe body.

With this construction, the rearward bottom end of the heel body is positioned a predetermined distance forward of the rearward end of the shoe body. Also, the heel configuration forming member is made of a resilient material. Accordingly, the rearward bottom end of the heel body which is closer to the axis of the ankle can assure easier walking, while providing a normal heel shape by the heel configuration forming member.

Another object is to provide a resilient heel configuration forming member which has a flexible coating.

These and other objects, features and advantages of the present invention will become more apparent upon a reading of the following detailed description and drawings.

BRIEF DESCRIPTION OF THE DRAWINGS

FIG. 5(*b*) is a front elevation view of each of the first and second embodiments;

FIG. 7(*b*) is a longitudinal sectional view of the inner member provided in the first and second embodiments;

FIG. 7(*c*) is a longitudinal sectional view of the second embodiment with the inner member removed;

DESCRIPTION OF THE PREFERRED EMBODIMENTS

Figure 1:
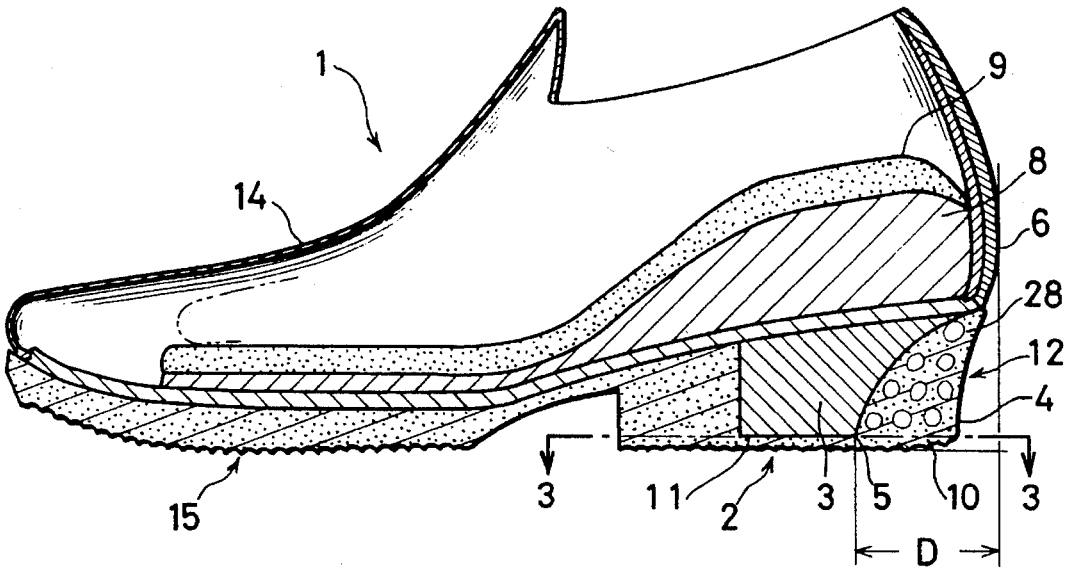
FIG. 1 is a sectional view showing a first embodiment of an elevating shoe according to the present invention.

FIG. 1 is a sectional view showing a first elevating shoe in accordance with the present invention. In FIG. 1, the first elevating shoe comprises a shoe body 1, an upper 14, a sole 15, a heel 2, and an inner member 8. The inner member 8 is fixedly provided or removably provided in the shoe body 1. Also, the inner member 8 may be shaped into one body integrally with the shoe body 1. An upper surface section 9 of the inner member 8 is made to be high in the vicinity of the heel 2.

As shown in FIG. 1, the heel 2 comprises a heel body 3 made of a heel material capable of supporting the weight of the wearer and a heel configuration forming member 4 made of a resilient material which is flexible as compared with the heel body 3. The heel body 3 substantially supports the wearer's weight. A rearward end 5 of the heel bottom 11 of the heel body 3 is positioned a distance D ahead of the rearward end 6 of the shoe body 1.

In addition, the heel configuration forming member 4, which is made of a flexible resilient material, is provided behind the heel body 3. The heel configuration forming member 4 extends from the rearward end of the heel body 3 so that the appearance of the heel configuration forming member 4 is that of a normal heel shape, such as the heel shape of conventional men's shoes or women's shoes.

Figure 2:
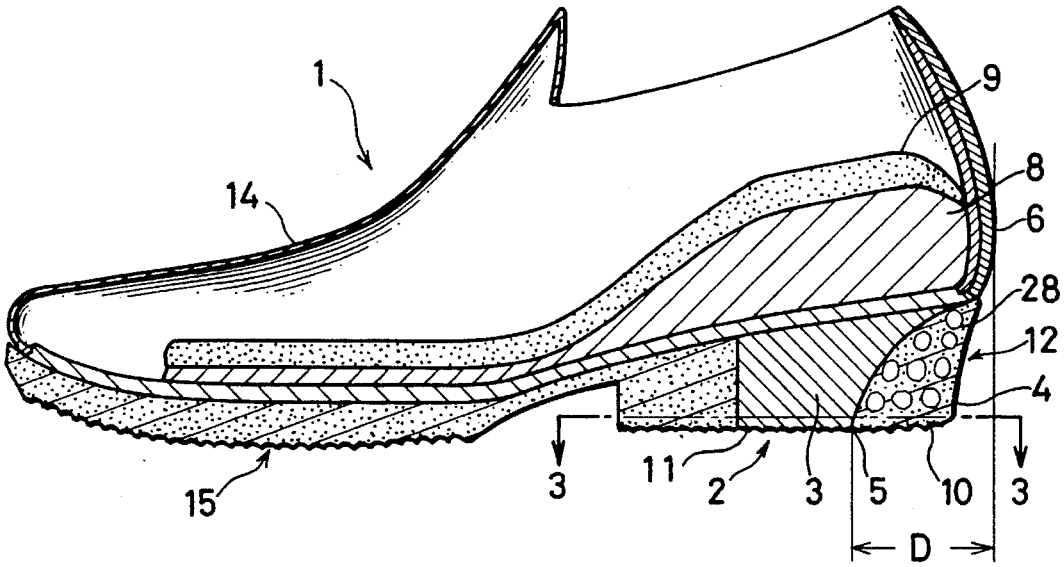
FIG. 2 is a sectional view showing a second embodiment of an elevating shoe according to the present invention.
Figure 4:
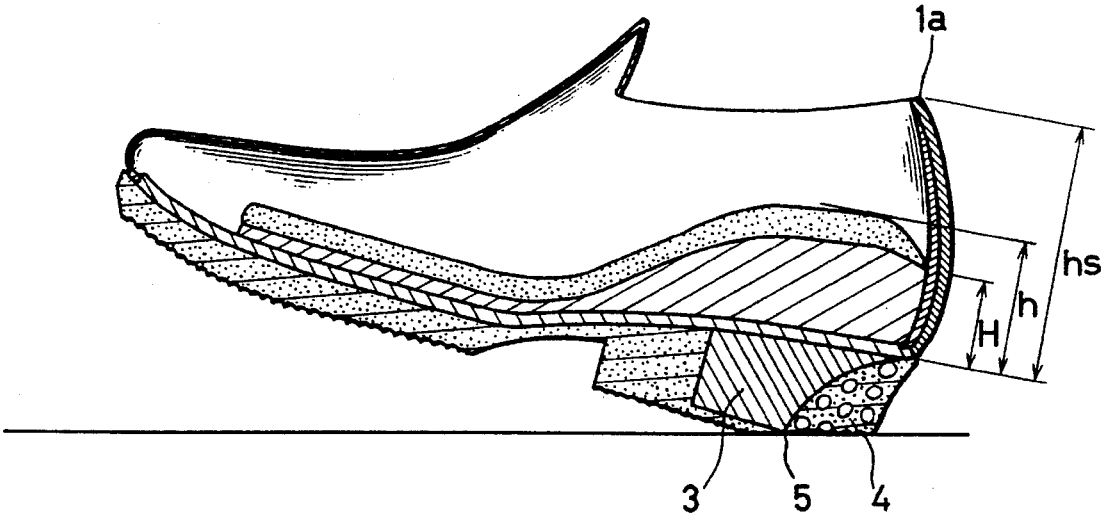
FIG. 4 is a sectional view showing the elevating shoe of FIG. 1 in its state of use.

The flexible material of the heel configuration forming member 4 may be such resilient materials as rubber, synthetic rubber, or plastic. The material may be formed into a predetermined shape while being solid, or may be provided with a great number of smaller pores, or a number of smaller pores and a number of larger pores, or a number of larger pores 28 as shown in FIGS. 1, 2 and 4, or with a single enclosed space. The larger pores and the enclosed spaces should not be exposed to the outside.

Figure 3:
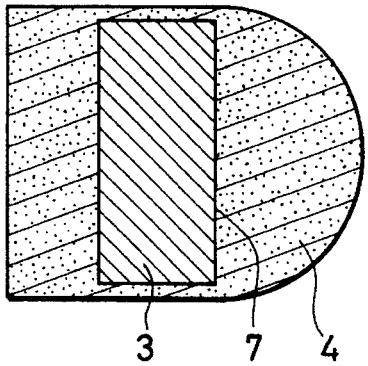
FIG. 3 is a sectional view taken along the line 3—3 in FIGS. 1 and 2.

In the first elevating shoe shown in FIG. 1, the bottom surface 11 of the heel body 3 is covered with the heel configuration forming member 4. However, as shown in FIG. 2, the bottom surface 11 of the heel body 3 may be exposed so as to come into direct contact with the ground. It should be noted that there is not any difference in the effect of the present invention between the first elevating shoe in which the bottom surface 11 of the heel body 3 is not exposed and the second elevating shoe in which the bottom surface 11 of the heel body 3 is exposed. Since the other parts of the second elevating shoe are the same as those of the first elevating shoe, the same parts are allotted the same reference numerals and their description is omitted. FIG. 3 is a sectional view taken along the line 3—3 in FIGS. 1 and 2.

Figure 14:
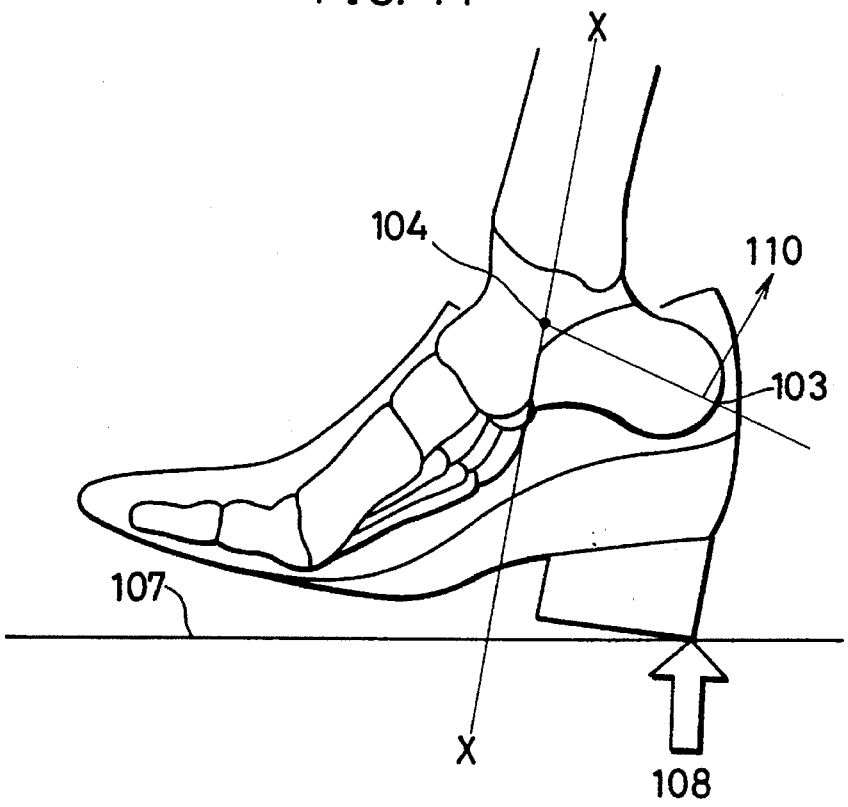
PRIOR ART FIG. 14
FIGS. 14–16 are schematic views illustrating the principles and forces which are operable when walking in a shoe of the type shown in FIG. 13.
Figure 15:
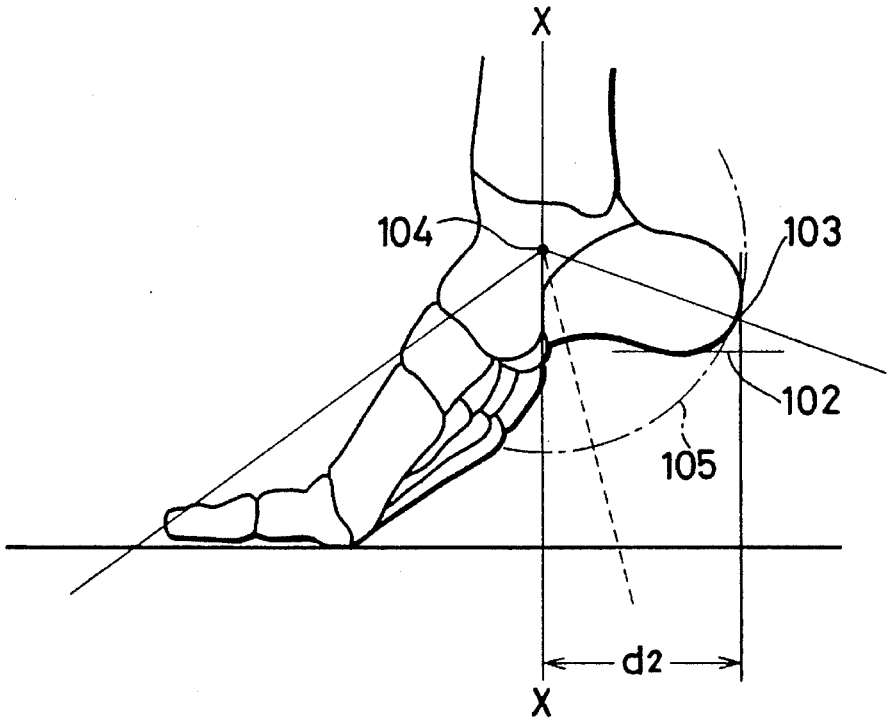
Figure 16:
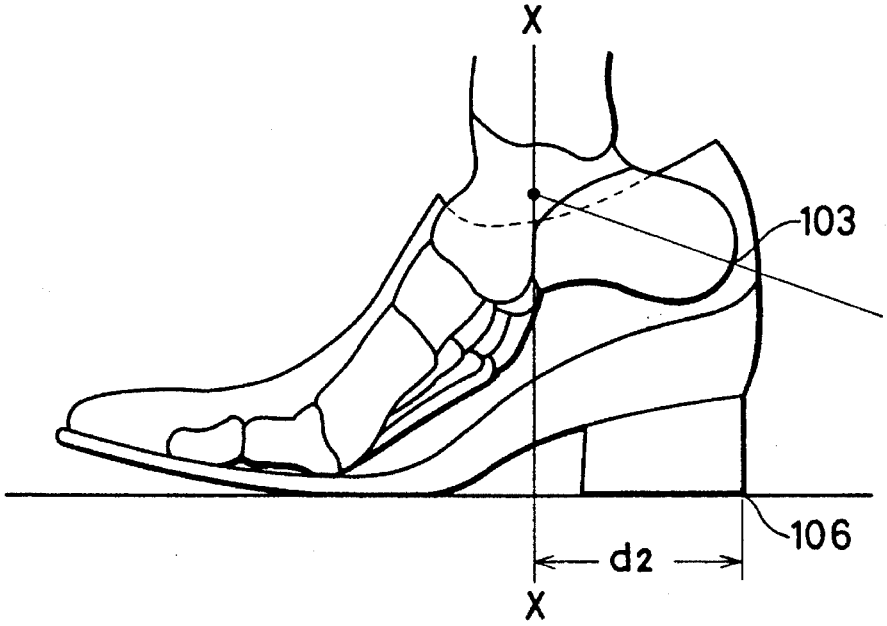
Figure 17:
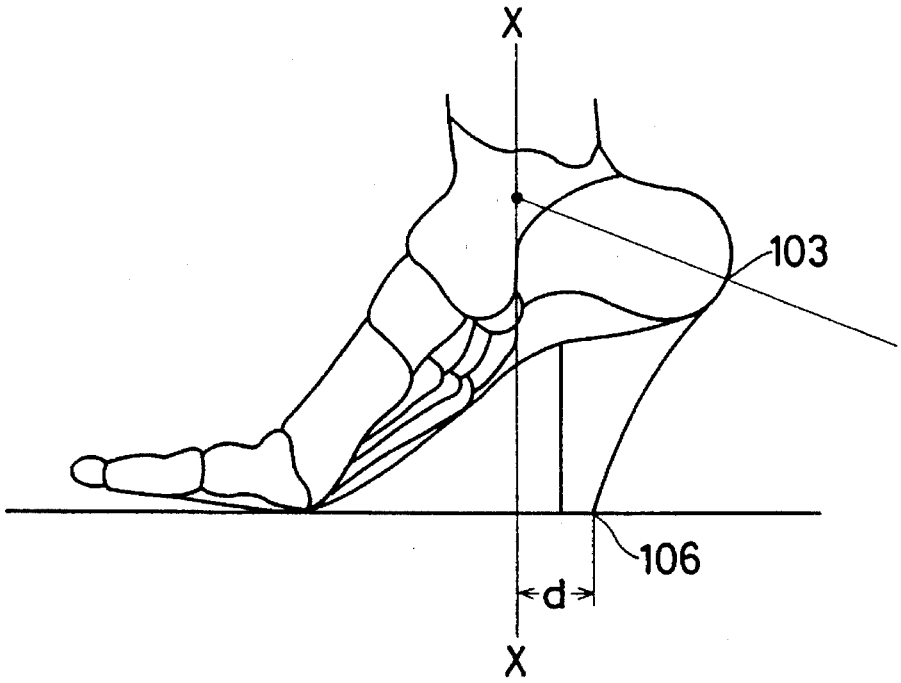
FIG. 17 is a schematic view of a foot and its position relative to a heel.
Figure 18:
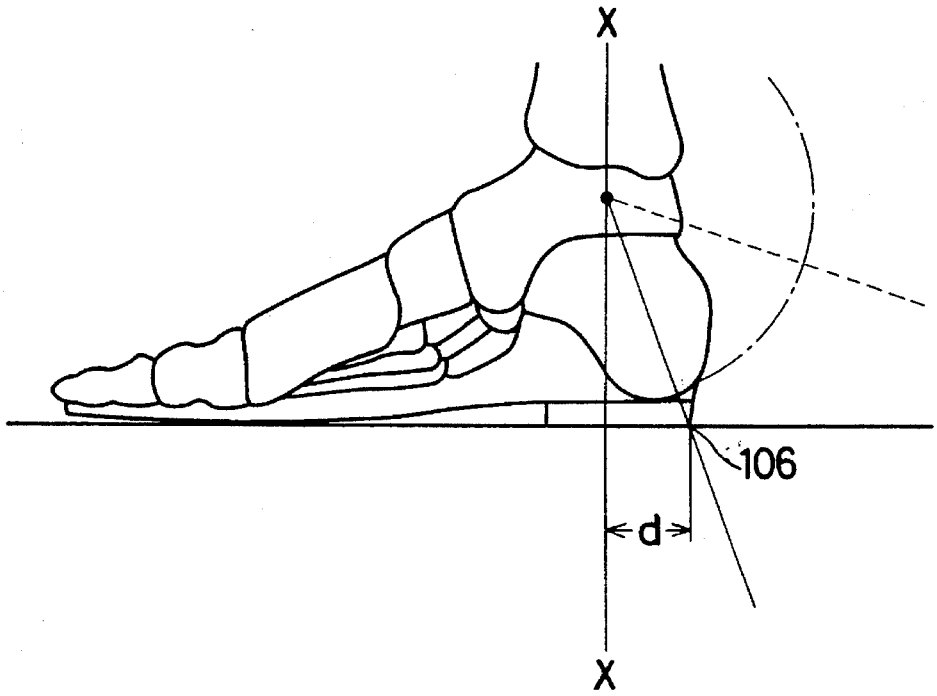
FIG. 18 is a schematic view of a foot and its position in relationship to a relatively low heel.

Next, the operational effect of the elevating shoes of the first and second embodiments will be described. As shown in FIG. 4, the heel body 3 supports the wearer's weight at the time of walking. On the other hand, the heel configuration forming member 4 substantially does not contribute to supporting the weight. The heel configuration forming member 4 is easily flexible. Therefore, the wearer does not receive such reaction force 108 from the ground surface 107 as described with reference to FIG. 14. The reaction force 108 is absorbed by the resilient deformation. Accordingly, the wearer can walk comfortably.

In addition, it is possible to increase the height of the upper surface 9 without involving the above-mentioned difficulty of U.S. Pat. No. 4,380,817. Accordingly, the desire of the wearer can be satisfied by providing a taller appearance than that attained by conventional elevating shoes.

Figure 8A:
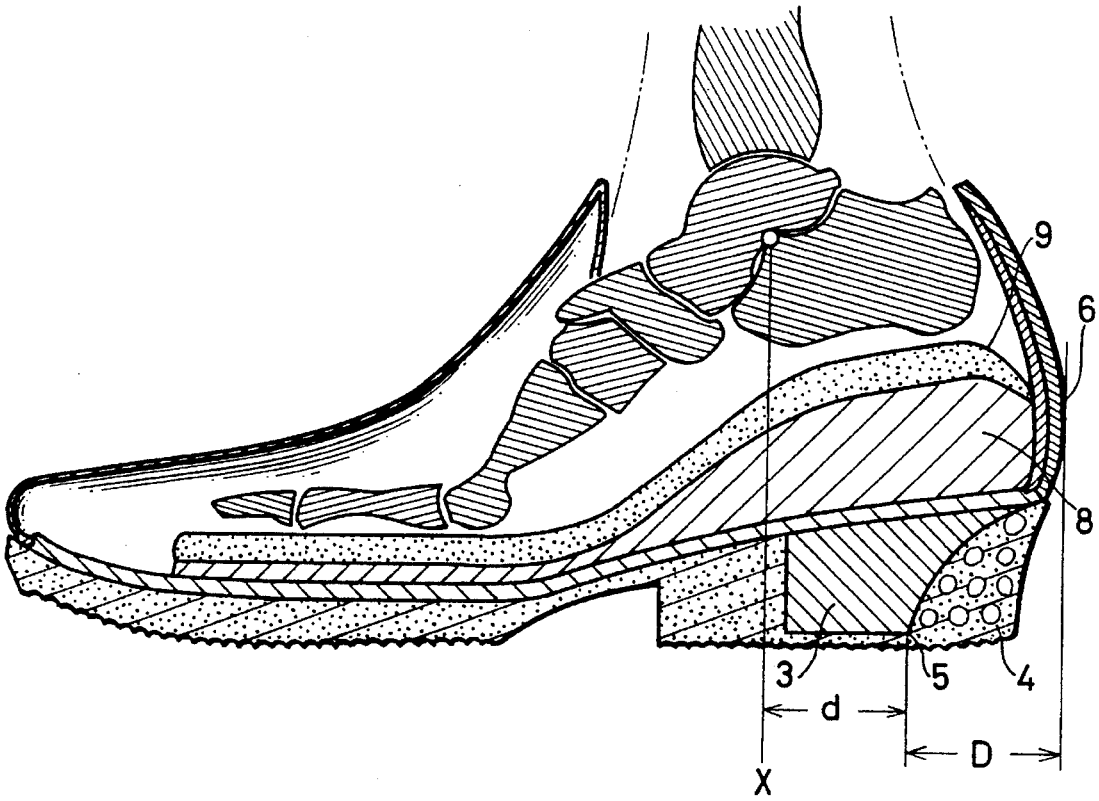
FIG. 8A is another sectional view showing the elevating shoe of the first embodiment.
Figure 8B:
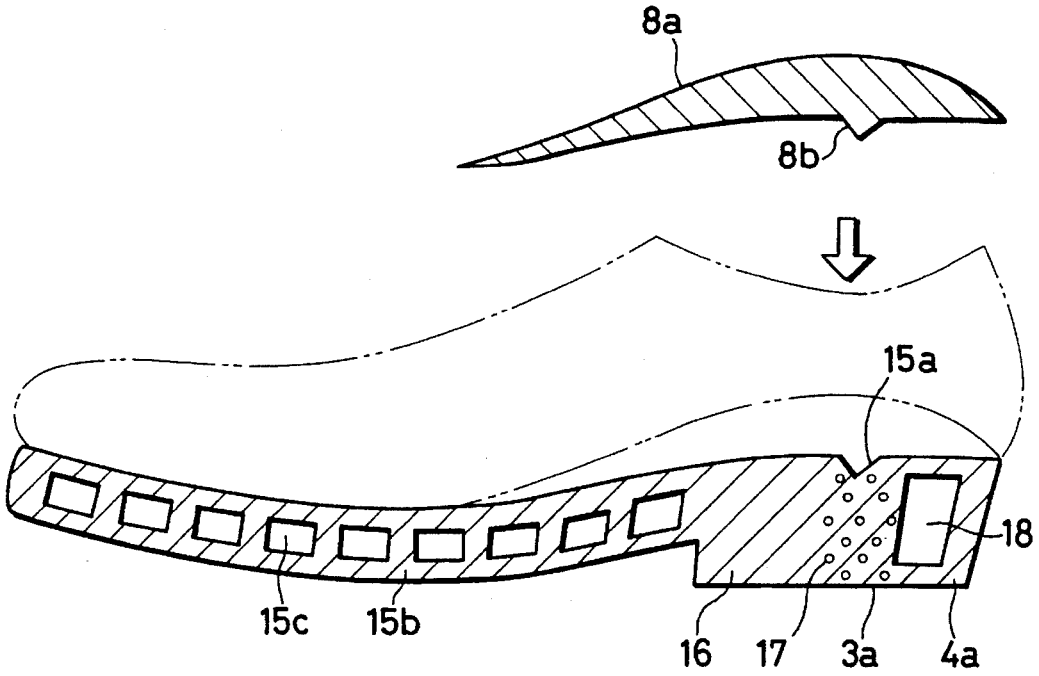
FIG. 8B is a sectional view of a shoe according to another embodiment of the invention.
Figure 19:
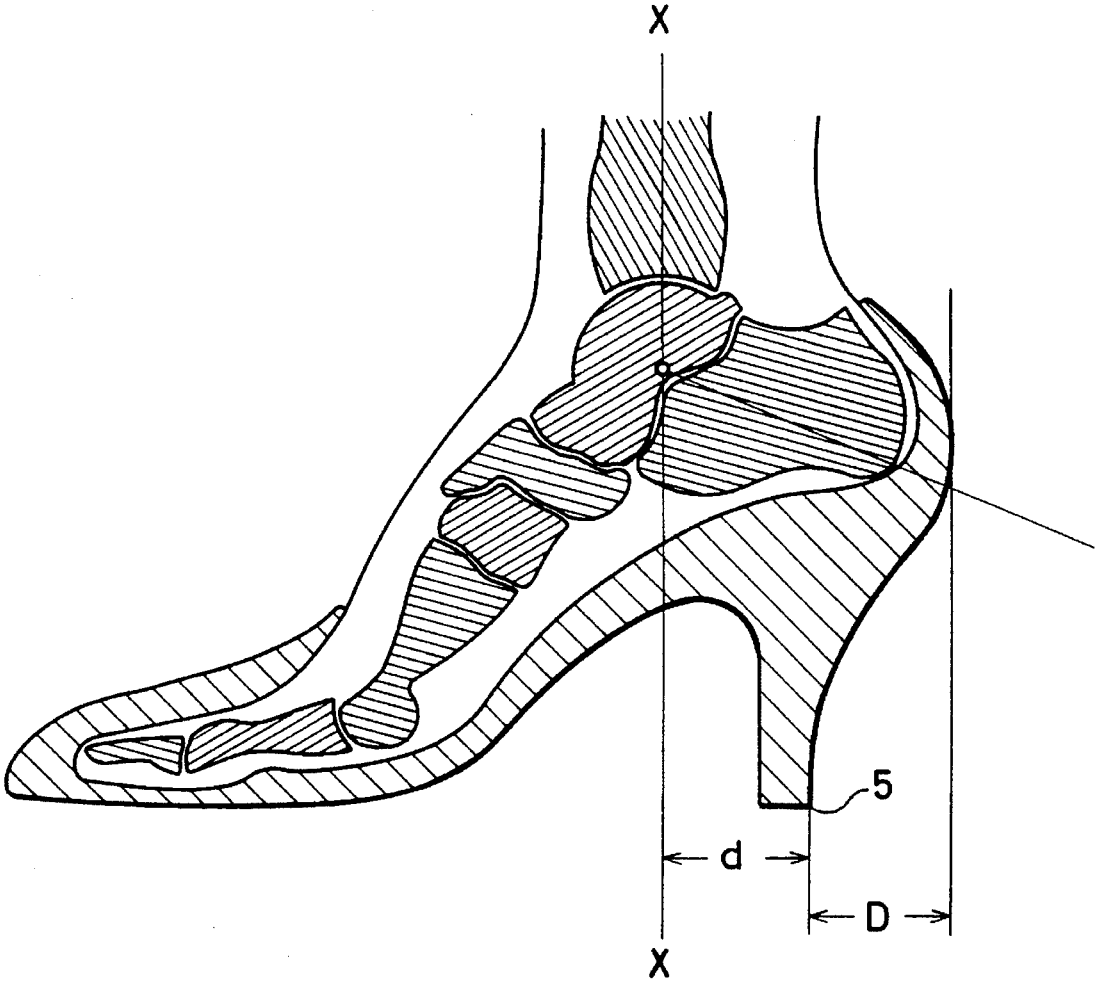
PRIOR ART FIG. 19
FIG. 19 is a cross-sectional view of a prior art high heel shoe.
Figure 20:
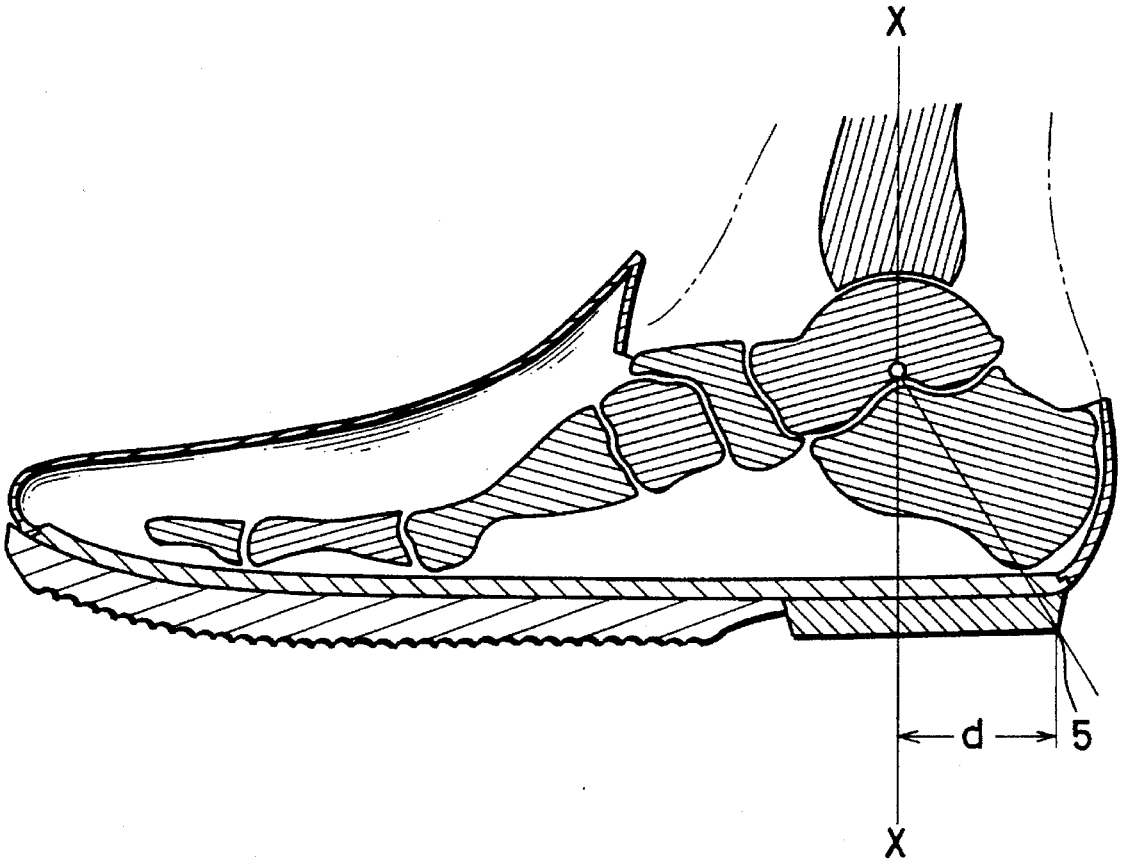
PRIOR ART FIG. 20
FIG. 20 is a sectional view of a prior art shoe with a relatively low heel.

FIG. 8 is similar to the embodiment of FIGS. 1, 2 and 4, but shows the skeletal structure of the foot in the same reduced scale as FIGS. 19 and 20. The distance d between the axis of the tibia bone X—X and the rear end of the heel body 3 as shown in FIG. 8 does not change appreciably irrespective of whether the shoe is a low heel shoe or a high heel shoe. The distance d shown in FIG. 8 is sometimes hereinafter referred to as the "easy-walking distance". The distance d in FIG. 8 is substantially the same as the distance d in FIGS. 19 and 20. Thus, the easy-walking distance d can be selected for the FIG. 8 embodiment which corresponds to the distance d in FIG. 19 or FIG. 20. Even if the height of the heel area of the shoe increases and the distance D increases, as previously described, the position of the rearward end 5 of the heel body 3, which defines the easy-walking distance d, is not effected substantially by said distance D.

A normal heel configuration can be obtained by the heel configuration forming member 4, even though the distance D increases for higher elevations of the heel, while the easy-walking distance d remains substantially the same. Thus, it is possible to make the inner member 8 (FIG. 8) thick so that the heel area may, for example, be as high as a regular ladies high heel shoe as shown in FIG. 19 while maintaining the desired easy-walking distance d as shown in FIG. 8.

Referring to FIG. 3, the heel body 3 substantially supports the wearer's weight and has a long rearward bottom end 7. The rearward bottom end 7 is wider than that of the usual women's high heel. Consequently, more stability can be obtained. It is usual that heels do not incline from side to side, but incline back and forth like a seesaw. Accordingly, the long rearward bottom end 7 can provide more comfortable walking to the wearer.

In addition, since the rearward bottom end 7 can be positioned freely independent of the appearance of the shoes, it can be positioned at the most comfortable position for walking, for example, the distance D shown in FIG. 1. The heel configuration forming member 4 forms a heel configuration having a plain heel for men or for both men and women. The heel may have various kinds of a bottom surface, for example, a flat or an uneven bottom surface, for example, an anti-skid uneven surface like a tire surface of an automobile.

Figure 5B:
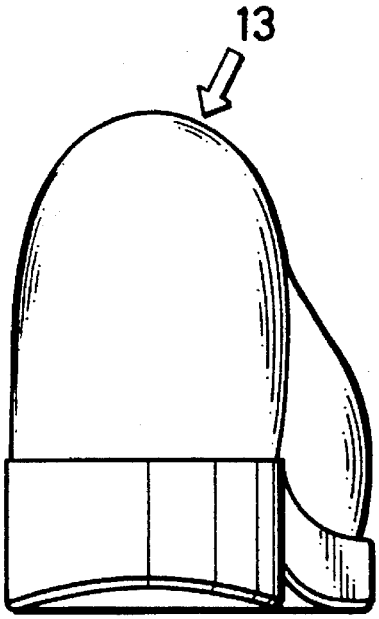
FIG. 5(*a*) is a rear elevation view of each of the first and second embodiments.
Figure 5B:
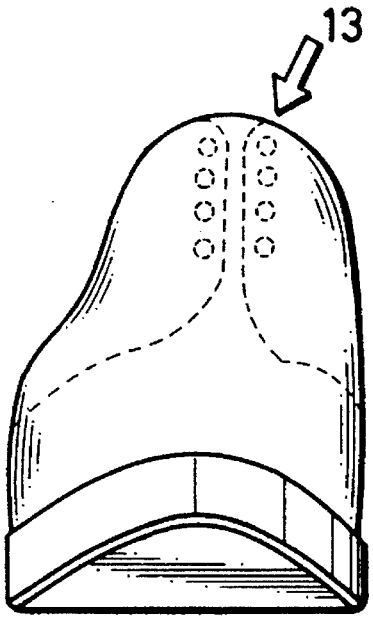
Figure 6:
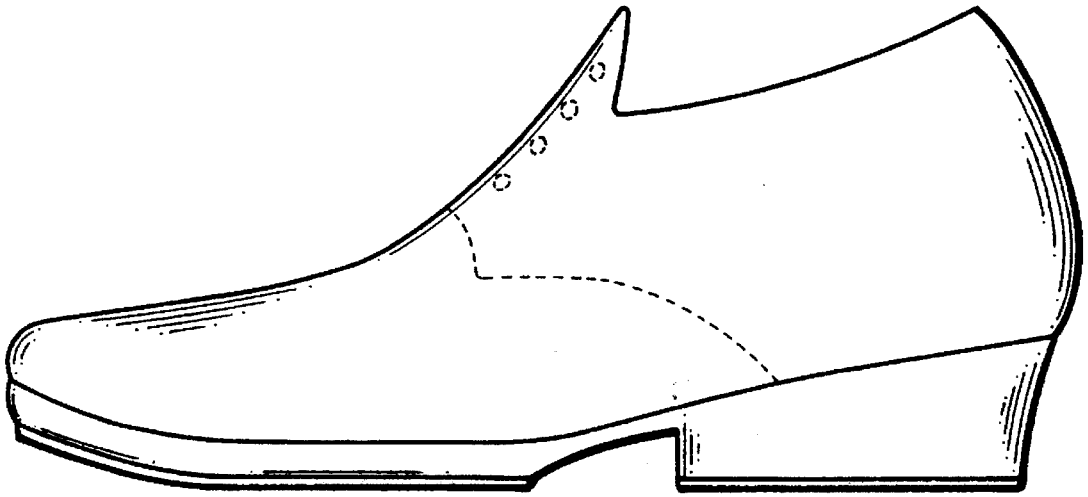
FIG. 6 is a side elevation view of each of the first and second embodiments.

The heel configuration is formed as shown in FIGS. 5(*a*) 5(*b*) and 6. There is little likelihood that the heel body 3 shown in FIGS. 1 and 2 is perceived by other persons because of the existence of the heel configuration member 4. Accordingly, the wearer does not feel ashamed.

Figure 7A:
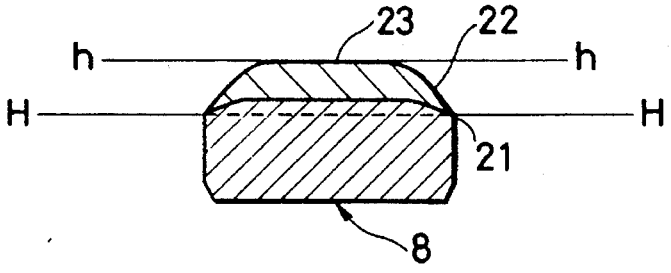
FIG. 7(*a*) is a cross-sectional view of an inner member taken along the line 7(*a*)—7(*a*) in FIG. 7(*b*)
Figure 7B:
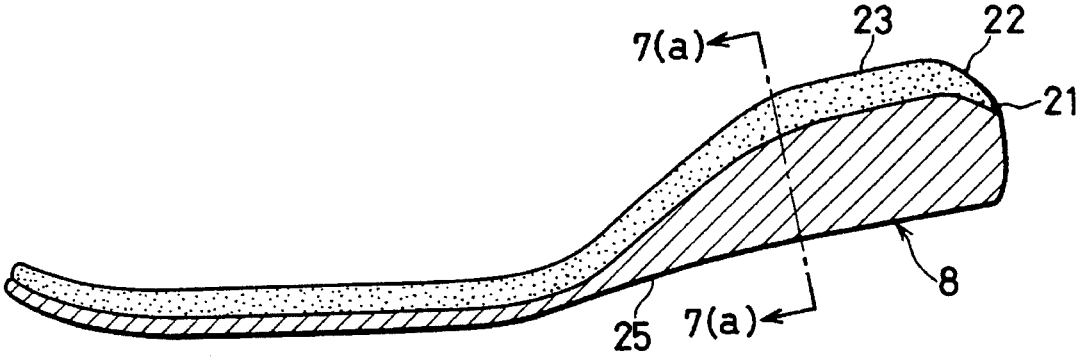
Figure 7C:
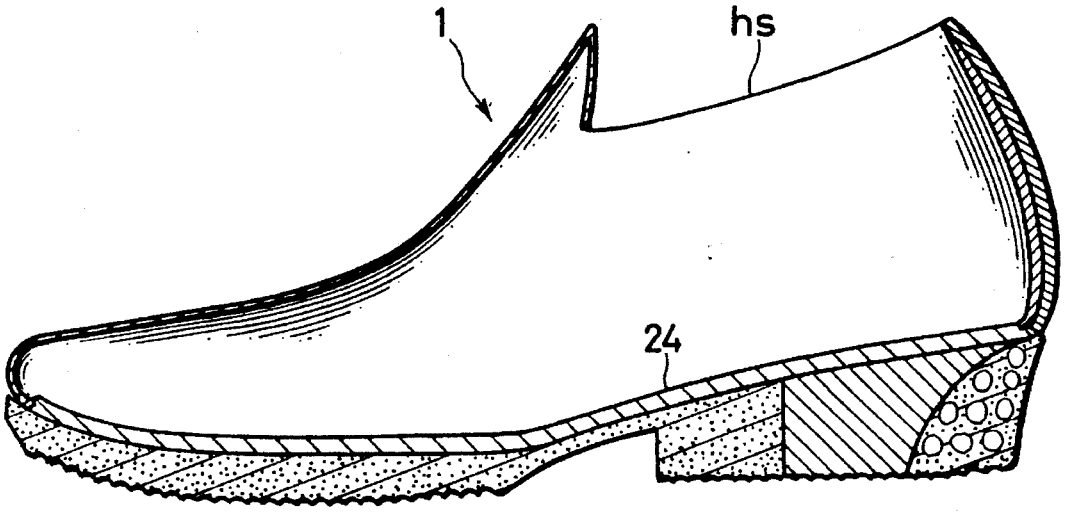

FIG. 7(*a*) shows the inner member 8 removably provided in the first and second elevating shoes. FIG. 7(*a*) is a cross-sectional view of the inner member 8 taken along the line 7*a*—7*a* in FIGS. 1, 2 and 7(*b*) and viewed in a direction shown by the arrows. Referring to FIG. 7(*a*), an upper layer of the inner member 8 comprises a rising surface 22 which rises from a peripheral edge 21 and a top surface 23 connected to the rising surface 22 without any step, both of which have the same color. The sectional configuration as described above causes other persons not to easily know that the inner member 8 provides a deceptive height as shown in FIGS. 7(*a*) and 7(*b*). The above-mentioned configuration of the inner member 8 has the effect of giving an illusion that the height of the inner member 8 is lower than its actual height. In addition, the rising surface 22 and the top surface 23 are connected without any step difference and have the same color. They have no color pattern or no uneven pattern. The color preferably has low chroma and low brightness, for example, the color is preferably grey, brown, or dark blue, and the color is preferably a different color against the color of the inner surface of the shoe body.

Next, the function of the inner member 8 will be described. Generally, it is known that, a distance is perceived by parallax of both eyes. More specifically, when the right and left eyes view an outline or a pattern of an object, images formed by the right eye and the left eye are slightly different from each other. The distance to the object can be perceived by the difference between the two images.

If an object has a uniform color, uniform brightness, no pattern and no outline like a clouded sky, a human being cannot perceive the distance to the object by means of the parallax of both eyes.

The configuration of the inner member 8 can be clearly perceived if a sectional view as shown in FIG. 7(*a*) is provided to the viewer. However, if such a sectional view is not provided, the viewer cannot perceive the configuration of the inner member 8 because the inner member 8 is surrounded by side walls of the shoe body 1. Consequently, it is reasonable to suppose that the viewer will have an imagination which is to be obtained from an upward position in the direction of an arrow 13 in FIGS. 5(*a*) and 5(*b*).

Therefore, it is very difficult for other persons to perceive the height of both rising surface 22 and the top surface 23 which are connected without any step difference and have no color pattern and no uneven surface. The person will perceive the peripheral edge 21 as a clear outline. The person will probably be deceived in believing that the height of the peripheral edge 21 is the height of the top surface 23, that is, the height H of the peripheral edge 21, rather than the height h of the top surface 23, so that the height of the top surface 23 looks lower. For example, if the height h of the top surface 23 is 7 cm, and the height H of the peripheral edge 21 is 5 cm, it looks 5 cm by virtue of the above-mentioned deception. Accordingly, the wearer does not feel ashamed. People perceive the height of the inner member not by a scale but by comparing it with a top edge/a of the side walls of the shoe body 1 as shown in FIG. 7(*c*).

For example, when the height of the side wall of the shoe body 1 is 10 cm, that of h is 7 cm, and that of H is 5 cm, the following facts are obtained:

Top surface depth:10 cm - 7 cm=3 cm

Peripheral edge depth:10 cm - 5 cm=5 cm

Ratio:5/3=166

Though the top surface depth is 3 cm, other people will be deceived to see 5 cm. Thus, the depth looks deep as much as 166%. As a result, the wearer does not feel ashamed of wearing the shoes.

FIG. 7(*b*) is a longitudinal sectional view showing the inner member 8 removed from the first and second elevating shoes shown in FIGS. 1 and 2. The inner member 8 may be attached to the shoe body 1 by adhesive, by screws, or the like. Also, the inner member 8 may be shaped as one body integrally with the shoe body 1. Further, the inner member 8 may be removably attached to the shoe body 1.

For casual shoes, the soles and the heel configuration forming member 4 may be made of a resilient material or a foamed material such as formed urethane resin. These materials have a sufficient resilient property with a plurality of pores which can be pressed and deformed while walking. These shoes are comfortable to wear and have a easy-walking characteristic as previously explained.

FIG. 8A shows an alternate embodiment wherein the inner member 8*a* is held in the shoe without any adhesive and without any other fastening means other than the projection 8*b* on the inner member 8*a* which is received in an indentation 15*a* in the upper portion of the heel. The projection 8*b* fitted into the indentation 15*a* serves to retain the inner member 8*a* in position in the shoe.

In the embodiment of FIG. 8A, the rear end portion of the heel, that is, the heel configuration forming portion 4*a*, is made of the same material as the front end portion 16 of the heel. However, an intermediate portion of the heel 3*a* is reinforced as represented by the dots 17 in FIG. 8A. Also, the heel configuration forming portion 4*a* has a hollow section 18. Thus, the reinforced portion 3*a* is stiff and rigid to correspond, in terms of function, for example, to the heel portion 3 in FIGS. 1 and 3. The heel configuration forming portion 4*a*, because it is hollow, is able to flex to thereby correspond, in terms of function, for example, to the rear flexible portion 4 of FIGS. 1 and 2.

In FIG. 8A the entire sole 15*b* and heel 16, 3*a* may be made integrally of the same material and hollow portions 15*c* may be formed throughout the sole 15*b* to make the sole 15*b* feel softer and more flexible while walking.

Figure 9:
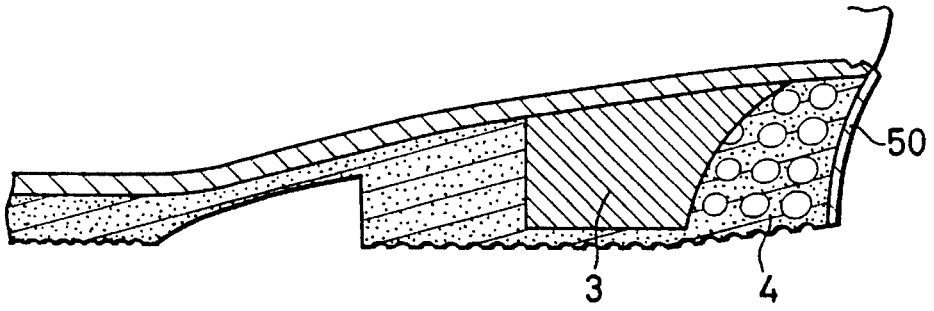
FIG. 9 is a partial sectional view of another embodiment of an elevating shoe according to the present invention.
Figure 10:
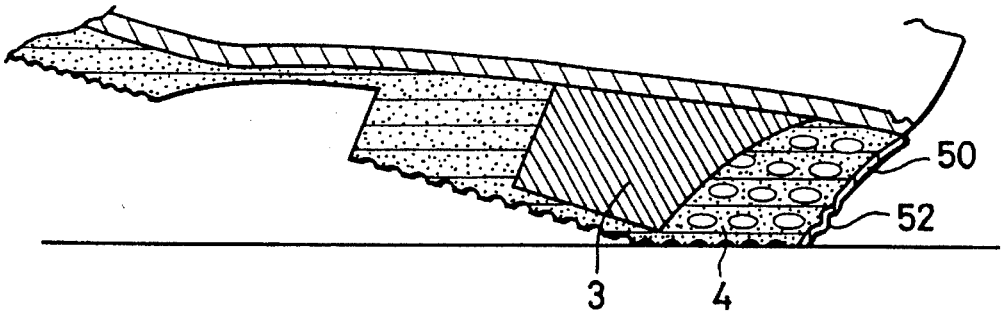
FIG. 10 is a partial sectional view of the FIG. 9 embodiment shown while in a state of use.

FIGS. 9 and 10 show such a casual shoe. However, there is also a need for a more formal shoe having the aforementioned easy-walking property.

Generally, the outside surface of the heel configuration forming member 4 consisting of a foamed material has a rough surface with many fine pores and the outside of the heel configuration forming member 4 does not shine sufficiently and is not sufficiently decorative. Because of the rough surface and pores, it is difficult to apply a satisfactory bright or decorative coating thereto, for example when it is desired to use the shoe for use in a more formal setting. Accordingly, if the outer surface of the heel configuration forming member 4 is coated with a coating or film 50 (FIG. 9) in order to attempt to obtain a bright or decorative finish when a person walks with such shoe the coating 50 becomes wrinkled such as indicated at 52 in FIG. 10. This occurs because the heel configuration forming member 4 is pressed against the surface being walked on and the heel configuration forming member 4 is compressed. Since the coating or film 50 cannot shrink or be foreshortened, wrinkles 52 occur in the coating 50 when the pressure is applied as shown in FIG. 10. Thus, the wrinkles 52 tend to remain on the coating 50 on the heel configuration forming member 4 even though the pressure is released.

Figure 11:
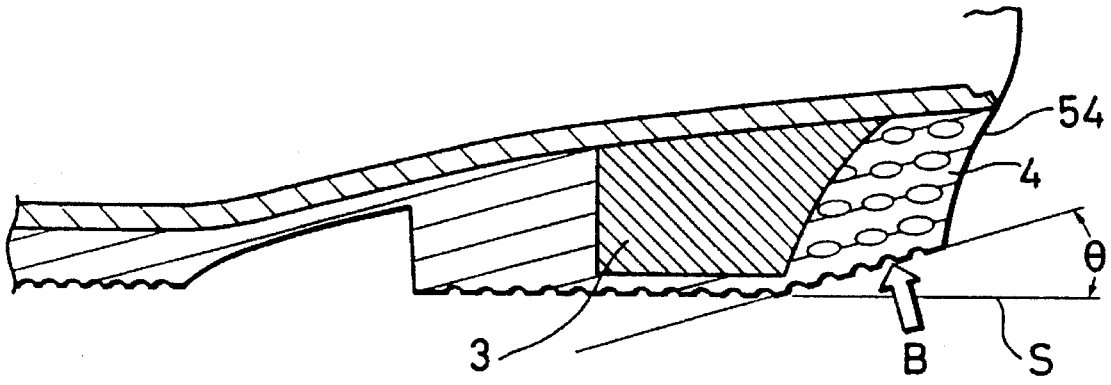
FIG. 11 is a partial sectional view of a further embodiment in which a coating has been applied to the heel while the heel is in a partially compressed state.
Figure 12:
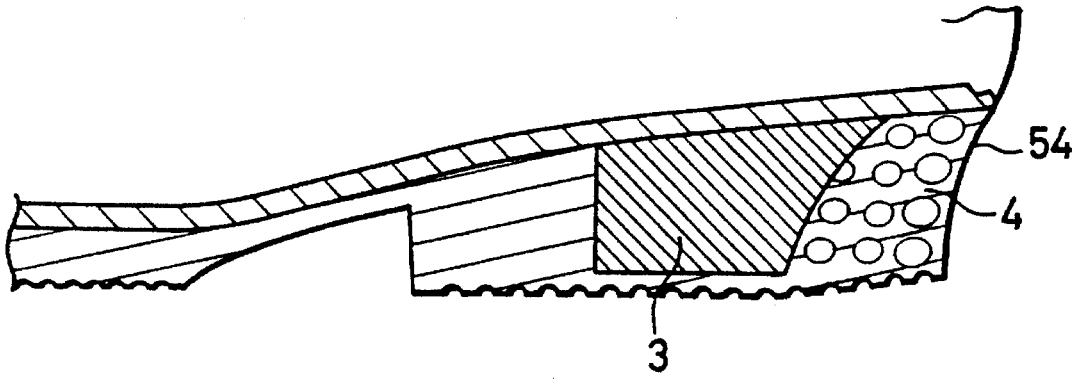
FIG. 12 is a view similar to FIG. 11, but showing the shoe with the heel in a non-compressed state.
Figure 13:
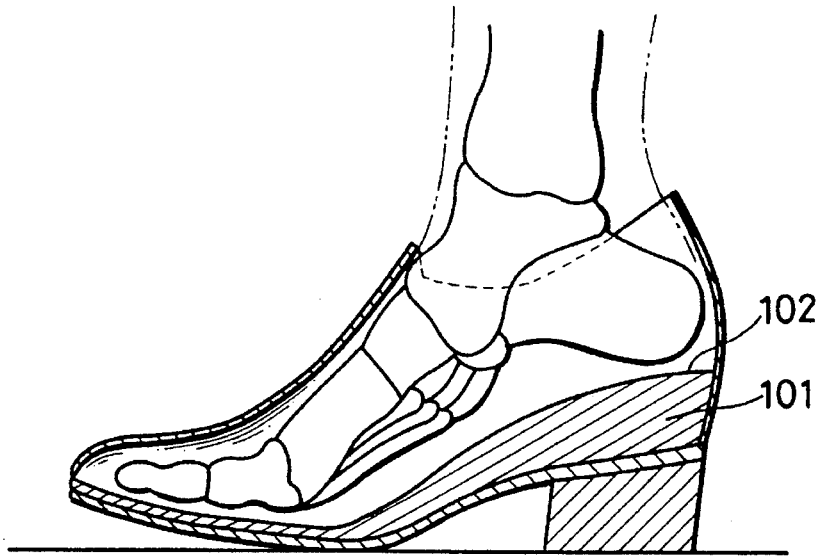
PRIOR ART FIG. 13
FIG. 13 shows a sectional view of a prior art shoe.

The aforementioned condition is alleviated with the embodiment shown in FIGS. 11 and 12. As shown in FIG. 11, the heel configuration forming member 4 is initially and temporarily pressed to a position resembling what occurs when a person walks with the shoe. Thus, a compression force B is applied to the heel configuration forming member 4 as shown in FIG. 11.

While the heel configuration forming member 4 is temporarily pressed so that the heel configuration forming member 4 forms an acute angle θ with the surface S as shown in FIG. 11, the outer surface of the heel configuration forming member 4 is coated with a liquid coating or film 54 having a desired appearance such as a bright color, for example. While the compressed state of FIG. 11 is maintained, the coating 54 is cured and hardened, the coating 54 thereby forming a film on the outer surface of the partially compressed heel configuration forming member 4.

Subsequently, the compression force B is released and the heel configuration forming member 4 resumes its normal uncompressed state as shown in FIG. 12 without impairing the aesthetic effect of the coating 54 to provide a smooth and decorative layer on the outer surface of the heel configuration conforming member 4. Thus, when the compression force B is released, the outer layer or film coating 54 is stretched as the heel configuration forming member 4 returns from its temporarily compressed state of FIG. 11 to its natural uncompressed state of FIG. 12. Accordingly, the heel configuration forming member 4 can be alternatively compressed and released as occurs during normal walking without creating any wrinkles because the coating 54 shrinks to the shortened condition shown in FIG. 11 when compressed during walking which is the condition at which the coating 54 was originally applied. The coating 54 "remembers" its initial shape and configuration and returns thereto during walking without creating any wrinkles. Accordingly, as a person walks with the shoe, no wrinkles occur in the coated material. Therefore, it is possible to apply a coating or film of desired brightness or a desired decorative effect to the outer surface of the heel configuration forming member 4.

Examples of coatings 54 which may be used are synthetic rubber dissolved in a solvent, natural rubber dissolved in a solvent or elastomers dissolved in a solvent. The solvent may be an organic solvent which is volatile and which evaporates away to leave an elastic film on the heel configuration forming member 4. Also, heat hardened elastomers which are hardened by heating to become an elastic film may be used.

Although the present invention has been fully described by way of example with reference to the drawings, it is to be understood that various changes and modifications will be apparent to those skilled in the art. Therefore, unless otherwise such changes and modifications depart from the scope of the invention, they should be construed as being included therein.

What we claim is:

1. A method of manufacturing a shoe adapted to be worn by a wearer having a tibia bone axis, said shoe having a shoe body with a rear terminating end, a heel having a bottom surface, and an inner member in the shoe body for raising the height of the wearer, comprising the steps of:

forming the inner member with a top surface positioned to overlie the heel, said top surface being disposed at a vertical height measured from said top surface to said bottom surface of the heel;

forming a heel body having a rear end;

forming a flexible heel configuration part having the configuration of a heel and being disposed rearwardly of said rear end of said heel body;

providing a first horizontal distance between said rear end of said heel body and said rear terminating end of said shoe body;

positioning said rear end of said heel body rearwardly of the tibia bone axis of the wearer at an approximate second horizontal distance extending between said rear end of said heel body and said tibia bone axis of the wearer;

providing said shoe with an elevated vertical height;

utilizing said elevated vertical height for determining said first horizontal distance such that greater first horizontal distances are provided for greater elevated vertical heights; and providing a substantially constant second horizontal distance for all elevated vertical heights.

* * * * *